US008878426B2

(12) United States Patent
Sakakura et al.

(10) Patent No.: US 8,878,426 B2
(45) Date of Patent: Nov. 4, 2014

(54) IGNITION PLUG

(71) Applicant: NGK Spark Plug Co., Ltd., Nagoya (JP)

(72) Inventors: Yasushi Sakakura, Aichi-ken (JP); Yuichi Matsunaga, Aichi-ken (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 14/182,607

(22) Filed: Feb. 18, 2014

(65) Prior Publication Data

US 2014/0239798 A1 Aug. 28, 2014

(30) Foreign Application Priority Data

Feb. 26, 2013 (JP) ..... 2013-035299

(51) Int. Cl.
*H01T 13/20* (2006.01)

(52) U.S. Cl.
CPC ..... *H01T 13/20* (2013.01)
USPC ..... 313/143; 313/141

(58) Field of Classification Search
USPC ..... 313/141–143
See application file for complete search history.

(56) References Cited

U.S. PATENT DOCUMENTS

| | | | | |
|---|---|---|---|---|
| 7,400,081 | B2 | 7/2008 | Ishiguro | 313/143 |
| 7,408,294 | B2 * | 8/2008 | Okabe et al. | 313/143 |
| 2006/0022566 | A1 | 2/2006 | Ishiguro | 313/143 |

FOREIGN PATENT DOCUMENTS

| | | | |
|---|---|---|---|
| JP | 2006-66385 | 3/2006 | H01T 13/36 |

* cited by examiner

*Primary Examiner* — Mary Ellen Bowman
(74) *Attorney, Agent, or Firm* — Kusner & Jaffe

(57) ABSTRACT

An ignition plug having enhanced seal performance, while suppressing deformation of a metallic shell thereof. The ignition plug includes a metallic shell having a crimp portion, a male screw portion, a seat portion, and a bent portion. The bent portion has a largest outer diameter (OD) portion, and first and second smallest OD portions, wherein $0.01 \leq (L2+L3-L1)/(L2+L3) \leq 0.3$ is satisfied. L1 is distance between a point in the first smallest OD portion farthest from center axis and a point in the second smallest OD portion farthest from center axis, L2 is distance between the point in the first smallest OD portion farthest from center axis and a point in the largest OD portion farthest from center axis, and L3 is distance between the point in the second smallest OD portion farthest from center axis and the point in the largest OD portion farthest from center axis.

5 Claims, 3 Drawing Sheets

<RESULTS OF SEAL PERFORMANCE TEST>

| Buckling ratio | | 0.005 | 0.01 | 0.015 | 0.3 | 0.35 |
|---|---|---|---|---|---|---|
| Evaluation results (Threshold temp.) | Ls = 30 mm | CC (150°C) | BB (200°C) | AA (≥250°C) | AA (≥250°C) | AA (≥250°C) |
| | Ls = 35 mm | CC (100°C) | BB (200°C) | AA (≥250°C) | AA (≥250°C) | AA (≥250°C) |
| Deformation of tool engagement portion | | Not deformed | Not deformed | Not deformed | Not deformed | Deformed |

IGNITION PLUG

FIELD OF THE INVENTION

The present invention relates to an ignition spark.

BACKGROUND OF THE INVENTION

An ignition plug having a structure in which a center electrode is inserted into an insulator and the insulator is inserted into a metallic shell has been used as an ignition plug for igniting an internal combustion engine such as a gasoline engine. In a process of manufacturing such an ignition plug, an end portion of the metallic shell located on one side along the insertion direction of the insulator is crimped, whereby the metallic shell is fixed to the insulator (see Japanese Patent Application Laid-Open (kokai) No. 2006-66385 "Patent Document 1"). Since such an ignition plug is used in an environment of very high temperature and high pressure, the ignition plug has been demanded to have high seal performance. In order to meet such demand, conventionally, a load applied to the metallic shell for crimping (hereinafter referred to "crimping load") is increased so as to increase the charging density of talc disposed between the crimp portion and the insulator, to thereby enhance the seal performance of the ignition plug.

However, if the crimping load is increased, the outer shape of a tool engagement portion of the metallic shell located adjacent to the crimp portion thereof deforms, which may cause a problem in that a tool cannot be engaged with the tool engagement portion. The tool engagement portion has a shape (e.g., a regular hexagonal shape) which matches the tool shape as viewed in plan. The tool is engaged with the tool engagement portion when the ignition plug is fixed to an internal combustion engine or the like. Also, if the crimping load is increased, there may arise a problem in that a male screw portion of the metallic shell used to fix the ignition plug to an internal combustion engine or the like increases in length, and fails to establish screw engagement with a female screw portion formed on the internal combustion engine or the like. As described above, when the method of increasing the crimping load is employed, the metallic shell deforms. Therefore, a limit is imposed on enhancement of seal performance.

SUMMARY OF THE INVENTION

The present invention has been accomplished in order to solve the above-mentioned problems, and can be realized as the following modes or application examples.

(1) According to one mode of the present invention, there is provided an ignition plug which comprises a center electrode; a tubular insulator into which the center electrode is inserted; and a tubular metallic shell into which the insulator is inserted and which has a crimp portion having a crimped rear end portion, a male screw portion for mounting, a seat portion located on the crimp portion side of the male screw portion and expanding radially, and a bent portion located on the crimp portion side of the seat portion. This ignition plug is characterized in that the bent portion has a largest outer diameter portion which is the largest in outer diameter measured from a center axis of the metallic shell, a first smallest outer diameter portion which is the smallest in the outer diameter in a portion of the bent portion located on the crimp portion side of the largest outer diameter portion, and a second smallest outer diameter portion which is the smallest in the outer diameter in a portion of the bent portion located on the seat portion side of the largest outer diameter portion; and, when, in the bent portion on a cross section containing the center axis, a distance between a point in the first smallest outer diameter portion which is the farthest from the center axis and a point in the second smallest outer diameter portion which is the farthest from the center axis is represented by L1, a distance between the point in the first smallest outer diameter portion which is the farthest from the center axis and a point in the largest outer diameter portion which is the farthest from the center axis is represented by L2, and the distance between the point in the second smallest outer diameter portion which is the farthest from the center axis and the point in the largest outer diameter portion which is the farthest from the center axis is represented by L3, $0.01 \leq (L2+L3-L1)/(L2+L3) \leq 0.3$ is satisfied. According to the ignition plug of this mode, since $0.01 \leq (L2+L3-L1)/(L2+L3)$ is satisfied, a portion which is buckled relatively greatly can be employed as the bent portion. Therefore, a relatively large load is applied to the metallic shell so as to buckle the bent portion, whereby the seal performance of the ignition plug can be improved. In addition, since $(L2+L3-L1)/(L2+L3) \leq 0.3$ is satisfied, it is possible to prevent an excessively large load from being applied to the metallic shell so as to buckle the bent portion. Therefore, deformation of the metallic shell can be suppressed.

(2) In the ignition plug of the above-described mode, $0.015 \leq (L2+L3-L1)/(L2+L3)$ may be satisfied. According to the ignition plug of this mode, seal performance can be enhanced even in an environment of very high temperature.

(3) The ignition plug of the above-described mode may further comprise a seal member disposed between an outer circumferential surface of the insulator and an inner circumferential surface of the metallic shell, which surfaces face each other in the direction of the center axis; and with one side of the ignition plug where the male screw portion is located being defined as a forward end side, and the other side of the ignition plug where the male screw portion is not located being defined as a rear end side, a distance, along the center axis, between a rear end of the crimp portion and a rear end of a contract region where the seal member is in contact with the insulator may be 35 mm or greater. In general, when the distance, along the center axis, between the rear end of the crimp portion and the rear end of a contract region where the seam member is in contact with the insulator is 35 mm or greater, in a high temperature environment, the amount of extension of the metallic shell increases, and seal performance is likely to decrease. However, since the ignition plug of this mode satisfies $0.01 \leq (L2+L3-L1)/(L2+L3) \leq 0.3$, deterioration of seal performance can be suppressed.

(4) In the ignition plug of the above-described mode, the male screw portion may have a screw diameter of M18 or greater. In general, a large ignition plug whose male screw portion has a screw diameter of M18 or larger is used in a large apparatus such as an industrial gas engine. In such a large apparatus, the ignition plug is used at very high temperature and high pressure. Accordingly, even when the ignition plug of this mode is used in an environment of very high temperature and high pressure, deterioration of seal performance can be suppressed.

(5) In the ignition plug of the above-described mode, with one side of the ignition plug where the male screw portion is located being defined as a forward end side, and the other side of the ignition plug where the male screw portion is not located being defined as a rear end side, talc may be disposed between an outer circumferential surface of the insulator and an inner circumferential surface of the metallic shell at least in a portion of a region between a rear end of the crimp portion and a rear end of the bent portion. According to the ignition plug of this mode, talc is disposed between the outer circumferential surface of the insulator and the inner circumferential surface of the metallic shell at least in a portion of the region between the rear end of the crimp portion and the rear end of the bent portion. Therefore, the seal between the insulator and the metallic shell on the rear end side can be improved.

The present invention can be realized in various forms other than an ignition plug. For example, the present invention can be realized in the form of a method of manufacturing an ignition plug, in the form of a spark plug, or a method of manufacturing a spark plug.

DETAILED DESCRIPTION OF THE INVENTION

A. Embodiment

Figure 1:
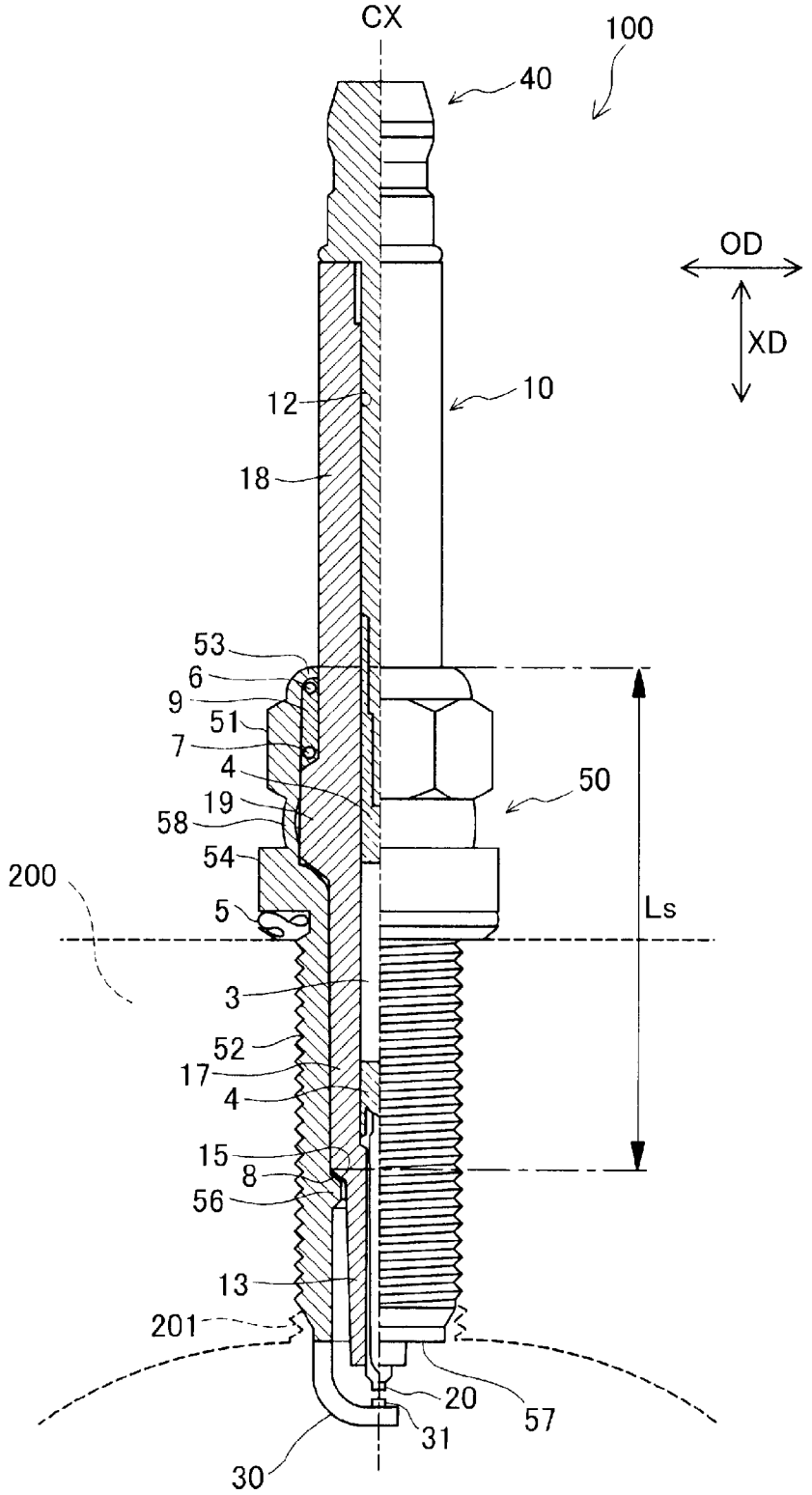
FIG. 1 is a partially sectioned view of a spark plug which is one embodiment of the present invention.

A-1. Structure of Spark Plug:

FIG. 1 is a partially sectioned view of a spark plug which is one embodiment of the present invention. In FIG. 1, an external shape of the spark plug 100 is shown on the right side of an axis CX, which is the center axis of the spark plug 100, and a cross-sectional shape of the spark plug 100 is shown on the left side of the axis CX. In the following description, the lower side of FIG. 1 (the side of the spark plug 100 where a ground electrode 30 to be described later is disposed) will be referred to as the "forward end side," and the upper side of FIG. 1 (the side of the spark plug 100 where a metallic terminal 40 to be described later is disposed) will be referred to as the "rear end side."

The spark plug 100 includes a center electrode 20, an insulator 10, the metallic terminal 40, a metallic shell 50, and the ground electrode 30. The axis CX of the spark plug 100 also serves as the center axes of the center electrode 20, the insulator 10, the metallic terminal 40, and the metallic shell 50.

The center electrode 20 is a rod-shaped electrode extending in a direction (axial direction XD) along the axis CX. The outer circumference of the center electrode 20, excluding a forward end portion thereof, is held by the insulator 10. The center electrode 20 may be formed of a nickel alloy (e.g., Inconel (registered trademark)), which contains nickel as a main component. The rear end of the center electrode 20 is electrically connected to the metallic terminal 40 through a ceramic resistor 3 and a seal 4.

The insulator 10 is a generally tubular insulator into which the center electrode 20, excluding a forward end portion thereof, is inserted. The insulator 10 may be formed by firing an insulating ceramic material such as alumina. The insulator 10 has a leg portion 13, an insulator step portion 15, a forward trunk portion 17, a center trunk portion 19, and a rear trunk portion 18 in this order from the forward end side toward the rear end side. The leg portion 13 is a tubular portion whose outer diameter decreases gradually from the rear end side toward the forward end side. The forward trunk portion 17 is a tubular portion having an outer diameter greater than that of the leg portion 13. The insulator step portion 15 is a portion for connecting the rear end of the leg portion 13 to the forward end of the forward trunk portion 17. The center trunk portion 19 is a portion which is disposed between the forward trunk portion 17 and the rear trunk portion 18 as viewed in the axial direction XD and which has an outer diameter greater than those of the forward trunk portion 17 and the rear trunk portion 18. The rear trunk portion 18 is disposed between the metallic shell 50 and the metallic terminal 40 so as to secure a sufficiently large insulating distance between the metallic shell 50 and the metallic terminal 40.

The metallic terminal 40 has a forward end portion accommodated in the axial hole 12 of the insulator 10, and a rear end portion projecting from the axial hole 12. An unillustrated high-voltage cable is connected to the metallic terminal 40, whereby high voltage is applied to the metallic terminal 40.

The metallic shell 50 is a tubular metal member into which the insulator 10 is inserted, and is formed of, for example, a metal such as low-carbon steel. The metallic shell 50 has a male screw portion 52, a seat portion 54, a bent portion 58, a tool engagement portion 51, and a crimp portion 53. The metallic shell 50 is fixed to the insulator 10 when the metallic shell 50 is crimped at the crimp portion 53.

The male screw portion 52 has a male screw formed on the outer circumferential surface thereof, and is disposed at the forward end of the metallic shell 50. When the spark plug 100 is attached to an engine head 200, the male screw comes into screw engagement with a female screw 201 of the engine head 200. A shell step portion 56 is formed on the inner circumferential surface of the male screw portion 52 such that the shell step portion 56 projects toward the center. The shell step portion 56 is disposed on the forward end side of the insulator step portion 15 of the insulator 10 as viewed in the axial direction XD. An annular sheet packing 8 is disposed between the shell step portion 56 and the insulator step portion 15 of the insulator 10. As shown in FIG. 1, the outer circumferential surface of the insulator step portion 15 faces toward the forward end side. In contrast, the upper end surface of the shell step portion 56 faces toward the rear end side. Therefore, the sheet packing 8 is disposed between the insulator step portion 15 and the shell step portion 56 as viewed in the axial direction XD.

The seat portion 54 is a portion expanding in the radial direction OD, and is adjacently located on the rear end side of the male screw portion 52. An annular gasket 5 formed by folding a plate is disposed between the seat portion 54 and the engine head 200.

The bent portion 58 has a wall thickness smaller than those of other portions of the metallic shell 50, and is adjacently located on the rear end side of the seat portion 54. The bent portion 58 is compressively deformed as a result of crimping at the crimp portion 53. The specific structure of the bent portion 58 will be described later.

The tool engagement portion 51 is adjacently located on the rear end side of the bent portion 58. The tool engagement portion 51 has a hexagonal cross-sectional shape, for example. When the spark plug 100 is attached to the engine head 200, a tool is engaged with the tool engagement portion 51.

Like the bent portion 58, the crimp portion 53 has a wall thickness smaller than those of other portions of the metallic shell 50. A rear end portion of the crimp portion 53 is bent inward (toward the center axis of the metallic shell 50). The crimp portion 53 is adjacently located on the rear end side of the tool engagement portion 51. Ring members 6 and 7 are disposed between the outer circumferential surface of the insulator 10 and a portion of the inner circumferential surface of the metallic shell 50, which portion extends from the tool engagement portion 51 to the crimp portion 53, such that the ring member 6 is located on the rear end side, and the ring member 7 is located on the forward end side. Each of the two ring members 6 and 7 has an annular external shape. Powder of talc 9 is charged between the two ring members 6 and 7. During manufacture of the spark plug 100, the crimp portion 53 is pressed toward the forward end side such that the crimp portion 53 is bent inward, whereby the bent portion 58 is compressively deformed. As a result of this compressive deformation of the bent portion 58, the insulator 10 is pushed forward within the metallic shell 50 via the ring members 6 and 7 and the talc 9. As a result of this pushing, the talc 9 is compressed in the axial direction XD, whereby the airtightness of the interior of the metallic shell 50 is enhanced. Also, as a result of this pushing, the insulator step portion 15 is pressed against the shell step portion 56 via the sheet packing 8, whereby the airtightness between the insulator 10 and the metallic shell 50 is enhanced.

The ground electrode 30 is a bent rod-shaped metal member. The ground electrode 30 may have a structure similar to that of the center electrode 20. Namely, the ground electrode 30 may be configured such that a core formed of copper or an alloy containing copper as a main component is embedded in a base material formed of a nickel alloy. One end portion of the ground electrode 30 is welded to an end surface 57 of the metallic shell 50, and the ground electrode 30 is bent such that the other end thereof faces a forward end portion of the center electrode 20. An electrode tip 31 is provided on a portion of the ground electrode 30 which faces the forward end of the center electrode 20. A gap (spark gap) for spark discharge is formed between the electrode tip 31 and the forward end of the center electrode 20.

Figure 2:
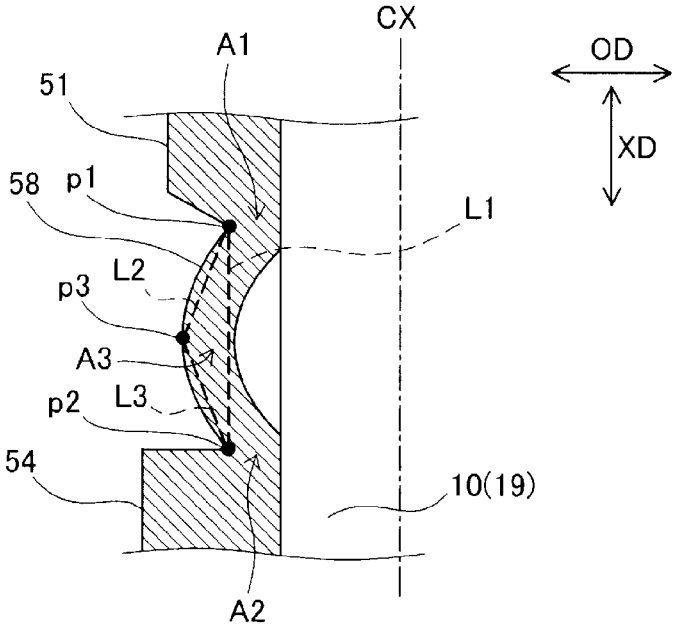
FIG. 2 is an explanatory view showing, on an enlarged scale, a bent portion 58 shown in FIG. 1.

FIG. 2 is an explanatory view showing, on an enlarged scale, the bent portion 58 shown in FIG. 1. In FIG. 2, the bent portion 58 and portions adjacent to the bent portion 58 are shown on an enlarged scale. As shown in FIG. 2, the outer circumferential surface of the bent portion 58 projects outward in the radial direction OD. The projection amount of the outer circumferential surface is the largest at a central portion thereof with respect to the axial direction XD, and gradually decreases toward the opposite ends thereof. Therefore, as shown in FIG. 2, a largest outer diameter portion A3 of the bent portion 58 located at the center thereof with respect to the axial direction XD is larger in outer diameter (average outer diameter) measured from the axis CX than other portions of the bent portion 58. A first smallest outer diameter portion A1 of the bent portion 58 located at the rearward end thereof with respect to the axial direction XD is smaller in the outer diameter (average outer diameter) measured from the axis CX than other portions of the bent portion 58 located on the rear end side of the largest outer diameter portion A3. A second smallest outer diameter portion A2 of the bent portion 58 located at the forward end thereof with respect to the axial direction XD is smaller in the outer diameter (average outer diameter) measured from the axis CX than other portions of the bent portion 58 located on the forward end side of the largest outer diameter portion A3.

In the spark plug 100 of the present embodiment, a first point p1 in the first smallest outer diameter portion A1 which is the farthest from the axis CX, a second point p2 in the second smallest outer diameter portion A2 which is the farthest from the axis CX, and a third point p3 in the largest outer diameter portion A3 which is the farthest from the axis CX have a positional relation which satisfies the following Expression (1). Notably, the points p1 to p3 are located on the outer circumferential surface of the bent portion 58.

$$0.01 \leq (L2+L3-L1)/(L2+L3) \leq 0.3 \quad (1)$$

In Expression (1), a variable L1 represents the distance between the first point p1 and the second point p2 as shown in FIG. 2. In Expression (1), a variable L2 represents the distance between the first point p1 and the third point p3 as shown in FIG. 2. In Expression (1), a variable L3 represents the distance between the second point p2 and the third point p3 as shown in FIG. 2.

In the case where the bent portion 58 buckles greatly, the largest outer diameter portion A3 projects greatly toward the outside, and the first point p1 and the second point p2 become closer to each other, whereby the values of the variables L2 and L3 increase, and the value of the variable L1 deceases. Accordingly, the value of (L2+L3−L1)/(L2+L3) increases. In the case where the bent portion 58 buckles greatly as described above, as a result of crimping at the crimp portion 53, the surface pressure at the sheet packing 8 increases greatly. Therefore, the seal performance (the degree of seal between the insulator 10 and the metallic shell 50) of the spark plug 100 is high. However, in the case where the degree of buckling of the bent portion 58 is very large, a very large load is applied to the spark plug 100 during the crimping operation. Therefore, the tool engagement portion 51 adjacent to the crimp portion 53 may deform, which may cause a problem in that a tool cannot be engaged with the tool engagement portion 51. In order to solve such a problem, the spark plug 100 of the present embodiment is configured to satisfy the above-described Expression (1), to thereby suppress the deformation of the tool engagement portion 51, while enhancing the seal performance. Specifically, in the spark plug 100 of the present embodiment, the crimping load applied for performing crimping at the crimp portion 53 and/or the charge amount of the talc 9 is adjusted so as to satisfy the above-described Expression (1). Notably, in the following description, the value of (L2+L3−L1)/(L2+L3) will be referred to as the "buckling ratio."

B. EXAMPLE

A plurality of samples (spark plugs 100) which satisfied the above-mentioned Expression (1) and a plurality of samples (comparative examples) (spark plugs) which did not satisfy the above-mentioned Expression (1) were fabricated, and a test for evaluating their seal performances was carried out. The fabricated samples differ from one another in the combination of buckling ratio and seal length Ls which will be described later. As shown in FIG. 1, the seal length Ls refers to a length (distance) between the rear end of the crimp portion 53 and the rear end of a contact region where the metallic shell 50 is in contact with the sheet packing 8. Such length corresponds to the length (in the axial direction XD) of a region within the spark plug where the sealing between the insulator 10 and the metallic shell 50 must be secured. Notably, the screw diameter of the male screw portion 52 of each sample was M18, and the distance between opposite apexes in the regular hexagonal shape (as viewed in plan) of the tool engagement portion 51 was 22.2 mm The spark plug whose screw diameter is M18 is a relatively large spark plug. Such a spark plug is used in a large apparatus such as an industrial gas engine. In such a large apparatus, a spark plug is used at very high temperature and high pressure. The spark plug 100 of the present example can have high seal performance even in an environment of very high temperature and high pressure.

Figure 3:
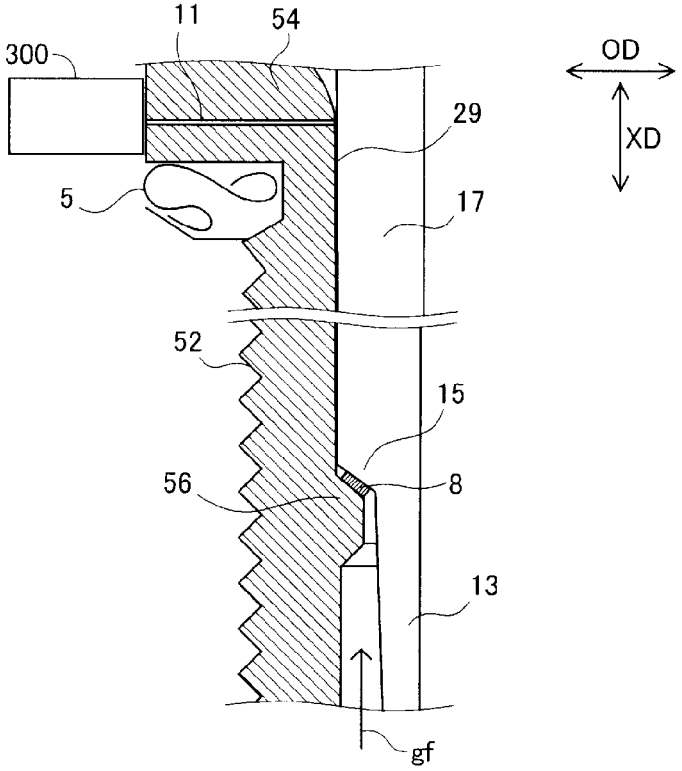
FIG. 3 is an explanatory view schematically showing a procedure of a seal performance test in the present example.

FIG. 3 is an explanatory view schematically showing a procedure of a seal performance test in the present example. In FIG. 3, of the spark plug 100 shown in FIG. 1, the male screw portion 52 and seat portion 54 of the metallic shell 50 and the leg portion 13 and the forward trunk portion 17 of the insulator 10 are shown on an enlarged scale.

As shown in FIG. 3, in each sample, a gas flow passage 11 penetrating the seat portion 54 in the thicknesswise direction (in the radial direction OD) was formed, and a gas detection device 300 was disposed at the outer end of the gas flow passage 11. A test gas gf was supplied to the space between the leg portion 13 and the male screw portion 52, and the amount (cc/min) of gas discharged through the gas flow passage 11 per unit time was measured by the gas detection device 300. In the present example, air was used as the test gas gf. The test gas gf was supplied under a pressure of 1.5 MPa. In the case where the seal performance realized by the sheet packing 8 is low, the test gas gf flows between the sheet packing 8 and the insulator step portion 15 or between the sheet packing 8 and the shell step portion 56, and reaches a small gap 29 between the outer circumferential surface of the forward trunk portion 17 and the inner circumferential surface of the male screw portion 52. The test gas gf then flows through the gas flow passage 11, and is detected by the gas detection device 300. In contrast, in the case where the seal performance realized by the sheet packing 8 is high, the amount of the test gas gf which reaches the gas flow passage 11 is small. As will be described later, the higher the seal performance, the higher the temperature at which the amount of gas (gas leakage amount) detected per unit time reaches a predetermined value. In view of this, in the present example, the seal performance of each sample was evaluated as follows. The seat surface temperature was changed while the test gas gf was supplied to each sample, and a temperature (hereinafter referred to as a "threshold temperature") at which the gas leakage amount per unit time reached a predetermined value (5 cc/min) was determined, and the seal performance of each sample was evaluated on the basis of the threshold temperature.

Figures 4, 5:
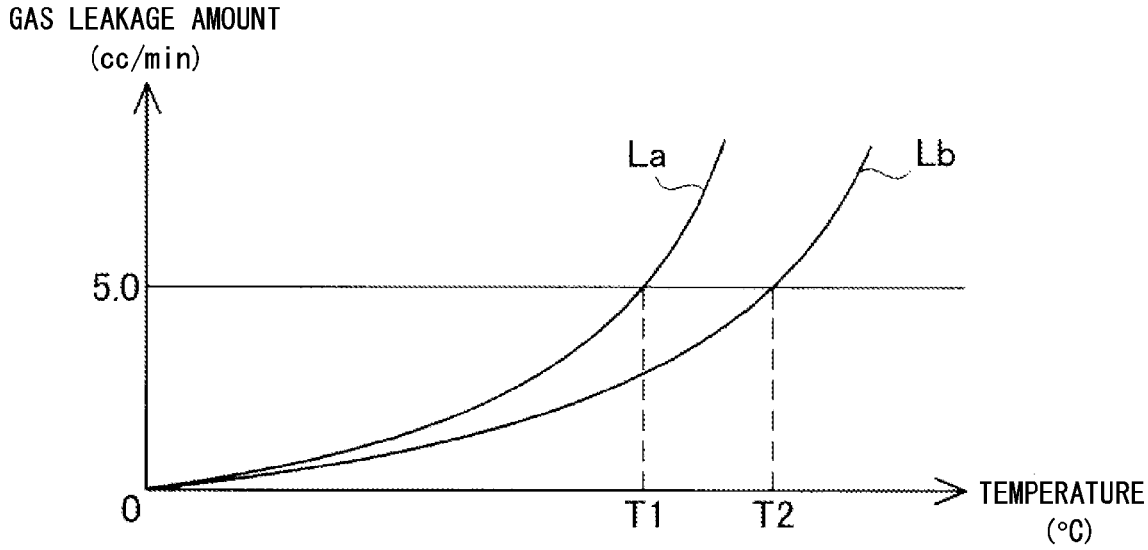
FIG. 4 is an explanatory view schematically showing a method of evaluating seal performance in the present example.
FIG. 5 is an explanatory table showing the results of the seal performance evaluation test.

FIG. 4 is an explanatory view schematically showing a method of evaluating seal performance in the present example. In FIG. 4, the vertical axis represents the gas amount per unit time (cc/min) measured by the gas detection device 300 of FIG. 3, and the horizontal axis represents the seat surface temperature (the temperature of the lower surface of the seat portion 54). A curve La in FIG. 4 shows the temperature characteristic of the gas leakage amount in a first sample (spark plug), and a curve Lb in FIG. 4 shows the temperature characteristic of the gas leakage amount in a second sample (spark plug) different from the first sample.

As shown in FIG. 4, in each of the first and second samples, the gas leakage amount per unit time increases with an increasing seat surface temperature. When the seat surface temperature increases, the metal which forms the male screw portion 52 expands, and the surface of the shell step portion 56 in contact with the sheet packing 8 may move toward the forward end side. Therefore, the surface pressure with which the sheet packing 8 is pressed decreases, and the seal performance realized by the sheet packing 8 lowers, whereby the gas leakage amount per unit time increases.

As shown in FIG. 4, in the case of the first sample, the gas leakage amount per unit time reached 5 cc/min when the seat surface temperature became equal to or higher than T1. In contrast, in the case of the second sample, the gas leakage amount per unit time reached 5 cc/min when the seat surface temperature became equal to or higher than T2 higher than T1. In the case where the two samples have such temperature characteristics of gas leakage amount, in the present example, the seal performance of the second sample was evaluated to be higher than that of the first sample.

FIG. 5 is an explanatory table showing the results of the seal performance evaluation test. As shown in FIG. 5, in the present example, the seal performances of 10 types of samples which differed from one another in the combination of the buckling ratio and the seal length Ls were evaluated. Specifically, the evaluation of seal performance was performed for five types of samples in which the seal length was set to 30 mm and the buckling ratio was set 0.005, 0.01, 0.015, 0.3, and 0.35, respectively, and for five types of samples in which the seal length was set to 35 mm and the buckling ratio was set 0.005, 0.01, 0.015, 0.3, and 0.35, respectively (10 types of samples in total). The evaluation of seal performance was performed as follows. When the threshold temperature of a sample was lower than 200° C., the seal performance of the sample was evaluated to be low (CC). When the threshold temperature of a sample was not lower than 200° C. and lower than 250° C., the seal performance of the sample was evaluated to be intermediate (BB). When the threshold temperature of a sample was equal to or higher than 250° C., the seal performance of the sample was evaluated to be high (AA). Also, for each of the ten types of samples in total, in addition to seal performance, presence/absence of deformation of the tool engagement portion 51 was evaluated (checked). The presence/absence of deformation of the tool engagement portion 51 was evaluated as follows. The length of opposite sides in the plan-view shape of the tool engagement portion 51 was measured. When the measured length was greater than the initial value (22.2 mm), the tool engagement portion 51 was determined to have deformed. When the measured length was equal to the initial value, the tool engagement portion 51 was determined not to have deformed. The length of the opposite sides of the tool engagement portion 51 and the variables L1, L2, and L3 for obtaining the buckling ratio can be measured by using a measuring tool such as calipers, or can be measured on the basis of an image of each sample captured through use of a projector. Notably, in the example, the wall thickness of the bent portion 58 was 0.60 mm. The wall thickness of the bent portion 58 is not limited to 0.60 mm, and may be set to an arbitrary value between 0.50 mm and 0.75 mm.

As shown in FIG. 5, as to the seal performance and the presence/absence of deformation of the tool engagement portion 51, substantially the same evaluation results were obtained for the group of samples having a seal length Ls of 30 mm and the group of samples having a seal length Ls of 35 mm. Specifically, of the group of samples having a seal length Ls of 30 mm, a sample having a buckling ratio of 0.005 had a relatively low threshold temperature (150° C.). However, samples having a buckling ratio of 0.01 or greater had relatively high threshold temperatures (200° C. or higher). In particular, the threshold temperatures of three samples having a buckling ratio of 0.015 or greater were very high (250° C. or higher). Accordingly, the sample having a buckling ratio of 0.005 was evaluated to be low in seal performance (CC), the sample having a buckling ratio of 0.01 was evaluated to be intermediate in seal performance (BB), and the three samples having a buckling ratio of 0.015 or greater were evaluated to be high in seal performance (AA). Similarly, of the group of samples having a seal length Ls of 35 mm, a sample having a buckling ratio of 0.005 had a relatively low threshold temperature (100° C.). However, samples having a buckling ratio of 0.01 or greater had relatively high threshold temperatures (200° C. or higher). In particular, the threshold temperatures of three samples having a buckling ratio of 0.015 or greater were very high (250° C. or higher). Accordingly, the sample having a buckling ratio of 0.005 was evaluated to be low in seal performance (CC), the sample having a buckling ratio of 0.01 was evaluated to be intermediate in seal performance (BB), and the three samples having a buckling ratio of 0.015 or greater were evaluated to be high in seal performance (AA).

As to the presence/absence of deformation of the tool engagement portion 51, the following was found. In each of the group of samples having a seal length Ls of 30 mm and the group of samples having a seal length Ls of 35 mm, deformation of the tool engagement portion 51 was not observed in the samples having a buckling ratio of 0.3 or less. However, deformation of the tool engagement portion 51 was observed in the sample having a seal length Ls of 30 mm and a buckling ratio of 0.35 and in the sample having a seal length Ls of 35 mm and a buckling ratio of 0.35. The two samples having a buckling ratio of 0.35 are relatively large in crimping load, as compared with other samples. Therefore, presumably, the tool engagement portion 51 was buckled in the axial direction XD by such load, whereby the plan-view shape of the tool engagement portion 51 changed.

It can be understood from the above-mentioned test results that, irrespective of the seal length Ls, a high seal performance can be obtained and deformation of the tool engagement portion 51 can be suppressed when the buckling ratio is not less than 0.01 and not greater than 0.3. In particular, it can be understood that, when the buckling ratio is equal to or greater than 0.015, the threshold temperature becomes 250° C. or higher, and a very high seal performance can be obtained.

The amount of extension of the male screw portion 52 in a high temperature, high pressure environment increases with the seal length Ls. Therefore, the greater the seal length Ls, the lower the surface pressure acting on the sheet packing 8 and the greater the possibility that the seal performance realized by the sheet packing 8 deteriorates. For example, when the two samples having a buckling ratio of 0.005 (the sample having a seal length Ls of 30 mm and the sample having a seal length Ls of 35 mm) are compared in FIG. 5, it is found that the threshold temperature of the sample having a longer seal length Ls is lower than that of the sample having a shorter seal length Ls, and the seal performance of the sample having a longer seal length Ls is low. However, in the case of the spark plug 100 of the present example which satisfies the above-mentioned Expression (1), as shown in FIG. 5, even a sample whose seal length Ls is relatively large (a sample having a seal length Ls of 35 mm) can have a seal performance as high as that of a sample whose seal length Ls is relatively small (a sample having a seal length Ls of 30 mm)

Also, according to the spark plug 100 of the present example, since high seal performance can be secured, it is unnecessary to increase the length of the leg portion 13 in the axial direction XD so as to prevent gas of high temperature and high pressure from flowing into the interior of the spark plug 100. Therefore, in the spark plug 100 of the present example, the length of the leg portion 13 in the axial direction XD can be decreased. Thus, the surface of the spark plug 100 exposed to the high temperature environment can be reduced in area. Accordingly, it is possible to prevent the temperature of the spark plug 100 itself from becoming very high, to thereby allow use of the spark plug 100 in a high temperature, high pressure environment.

C. Modifications

C1. Modification 1:

In the spark plug 100 of the above-described embodiment and example, talc is charged in the space between the outer circumferential surface of the insulator 10 and the inner circumferential surface of the metallic shell 50 extending from the tool engagement portion 51 to the crimp portion 53. However, the talc may be omitted. Even in such a configuration, the seal between the metallic shell 50 and the insulator 10 on the rear end side can be secured by performing a process of heating the metallic shell 50 and applying a compressive load to the metallic shell 50 in such a state, to thereby plastically deform it (so-called hot crimping process).

C2. Modification 2:

In the above-described embodiment and example, the screw diameter of the male screw portion 52 is M18. However, the present invention is not limited thereto. The male screw portion 52 may have a screw diameter larger than M18 or a screw diameter smaller than M18. A large spark plug whose male screw portion 52 has a screw diameter of M18 or larger may be used in a large apparatus such as an industrial gas engine. In general, in a large apparatus, such a spark plug is used in an environment of very high temperature and high pressure. However, when the present invention is applied to a spark plug having a screw diameter of M18 or greater, the spark plug can have high seal performance even in such an environment of very high temperature and high pressure.

C3. Modification 3:

In the above-described embodiment and example, the present invention is applied to a spark plug. However, the present invention may be applied to ignition plugs of other types such as an igniter plug.

Description of Reference Numerals and Symbols

3: ceramic resistor
4: seal
5: gasket
6: ring member
7: seal
8: sheet packing
9: talc
10: insulator
11: gas flow passage
12: axial hole
13: leg portion
15: insulator step portion
17: forward trunk portion
18: rear trunk portion
19: center trunk portion
20: center electrode
29: gap
30: ground electrode
31: electrode tip
40: metallic terminal
50: metallic shell
51: tool engagement portion
52: male screw portion
53: crimp portion
54: seat portion
56: shell step portion
57: end surface
58: bent portion
100: spark plug
200: engine head
300: gas detection device
gf: test gas
XD: axial direction OD: radial direction
CX: axis
A1: first smallest outer diameter portion
A2: second smallest outer diameter portion
A3: largest outer diameter portion
p1: first point
p2: second point
p3: third point Having described the invention, the following is claimed:

1. An ignition plug comprising:

a center electrode;

a tubular insulator into which the center electrode is inserted; and a tubular metallic shell into which the insulator is inserted, said tubular metallic shell including a crimp portion having a crimped rear end portion, a male screw portion for mounting, a seat portion located on the crimp portion side of the male screw portion and expanding radially, and a bent portion located on the crimp portion side of the seat portion, wherein the bent portion has a largest outer diameter portion which is the largest in outer diameter measured from a center axis of the metallic shell, a first smallest outer diameter portion which is the smallest in the outer diameter in a portion of the bent portion located on the crimp portion side of the largest outer diameter portion, and a second smallest outer diameter portion which is the smallest in the outer diameter in a portion of the bent portion located on the seat portion side of the largest outer diameter portion; and wherein, in the bent portion on a cross section containing the center axis, $0.01 \leq (L2+L3-L1)/(L2+L3) \leq 0.3$ is satisfied, where:

L1 is a distance between (i) a point in the first smallest outer diameter portion which is the farthest from the center axis and (ii) a point in the second smallest outer diameter portion which is the farthest from the center axis, L2 is a distance between (i) the point in the first smallest outer diameter portion which is the farthest from the center axis and (ii) a point in the largest outer diameter portion which is the farthest from the center axis, and L3 is the distance between the point in the second smallest outer diameter portion which is the farthest from the center axis and the point in the largest outer diameter portion which is the farthest from the center axis.

2. An ignition plug according to claim 1, wherein $0.015 \leq (L2+L3-L1)/(L2+L3)$ is satisfied.

3. An ignition plug according to claim 1, further comprising:

a seal member disposed between an outer circumferential surface of the insulator and an inner circumferential surface of the metallic shell, said outer and inner circumferential surfaces face each other in the direction of the center axis; and with one side of the ignition plug where the male screw portion is located being defined as a forward end side, and the other side of the ignition plug where the male screw portion is not located being defined as a rear end side, a distance, along the center axis, between a rear end of the crimp portion and a rear end of a contract region where the seal member is in contact with the insulator is 35 mm or greater.

4. An ignition plug according to claim 1, wherein the male screw portion has a screw diameter of M18 or greater.

5. An ignition plug according to claim 1, wherein, with one side of the ignition plug where the male screw portion is located being defined as a forward end side, and the other side of the ignition plug where the male screw portion is not located being defined as a rear end side, talc is disposed between an outer circumferential surface of the insulator and an inner circumferential surface of the metallic shell at least in a portion of a region between a rear end of the crimp portion and a rear end of the bent portion.

* * * * *